US006155523A

United States Patent [19]

Pitre

[11] Patent Number: 6,155,523

[45] Date of Patent: Dec. 5, 2000

[54] MAGNETIC BASE HOLDER

[75] Inventor: Daniel Pitre, Chertsey, Canada

[73] Assignee: Magnafix Inc., Ville d'Anjou, Canada

[21] Appl. No.: 09/184,242

[22] Filed: Nov. 2, 1998

Related U.S. Application Data

[60] Provisional application No. 60/089,876, Jun. 19, 1998.

[51] Int. Cl.[7] ..... A47G 1/17

[52] U.S. Cl. ..... 248/206.5; 248/309.4; 248/467

[58] Field of Search ..... 248/467, 206.5, 248/309.4, 302, 303, 304

[56] References Cited

U.S. PATENT DOCUMENTS

| | | | |
|---|---|---|---|
| 725,678 | 4/1903 | Cullum | 248/303 |
| 1,333,600 | 3/1920 | Bell | 248/303 |
| 2,459,909 | 1/1949 | Alofs | 248/303 |
| 2,531,151 | 11/1950 | Patt | 248/303 |
| 2,609,042 | 9/1952 | Chamberlain . | |
| 2,747,079 | 5/1956 | Kubiliunas | 248/206.5 |
| 2,813,710 | 11/1957 | Angle . | |
| 2,877,971 | 3/1959 | Goldstein | 248/302 |
| 2,948,407 | 8/1960 | Wiszuk | 248/206.5 |
| 2,977,082 | 3/1961 | Harris . | |
| 3,023,991 | 3/1962 | Fisher . | |
| 3,118,207 | 1/1964 | Breslow . | |
| 3,126,190 | 3/1964 | Miller | 248/206.5 |
| 3,239,179 | 3/1966 | Margulis . | |
| 3,266,633 | 8/1966 | Graebner | 248/309.4 |
| 3,275,818 | 9/1966 | Campbell . | |
| 3,291,429 | 12/1966 | Neanhouse | 248/206.5 |
| 3,306,308 | 2/1967 | Shanok | 248/206.5 |
| 3,341,996 | 9/1967 | Jones et al. . | |
| 3,365,684 | 1/1968 | Stemke | 248/206.5 |
| 3,518,884 | 7/1970 | Wood | 248/206.5 |
| 3,950,894 | 4/1976 | DiMaio . | |
| 4,060,905 | 12/1977 | Light . | |
| 4,192,101 | 3/1980 | White . | |
| 4,373,569 | 2/1983 | Barettella . | |
| 4,703,586 | 11/1987 | Smith et al. . | |
| 4,727,462 | 2/1988 | Komonko . | |
| 4,884,824 | 12/1989 | Radke | 280/770 |
| 5,077,948 | 1/1992 | Olson et al. . | |
| 5,078,281 | 1/1992 | Johnson . | |
| 5,411,231 | 5/1995 | Buck . | |
| 5,496,104 | 3/1996 | Arnold et al. . | |
| 5,746,329 | 5/1998 | Rondeau . | |
| 6,055,774 | 5/2000 | Muddiman | 49/141 |

FOREIGN PATENT DOCUMENTS

| | | | |
|---|---|---|---|
| 952505 | 3/1971 | Canada . | |
| 2077023 | 2/1993 | Canada . | |
| 559 791 | 9/1932 | Germany | 248/302 |

*Primary Examiner*—Anita M. King
*Assistant Examiner*—N. Sanders
*Attorney, Agent, or Firm*—Oblon, Spivak, McClelland, Maier & Neustadt, P.C.

[57] ABSTRACT

A device for holding an object to a magnetizable surface, has a magnetic base including a magnet recessed in a housing and a hook removably connectable to the housing. The magnet has an external face devised to face the magnetizable surface, an internal face opposite the external face and a sidewall. The housing is sized to accommodate the magnet in a loose manner so that an air gap is formed between the housing and the magnet. The housing includes a side wall that extends beyond the side wall of the magnet such that, in use, an air gap is formed between the magnet and the magnetizable surface. The hook includes an anchoring section slidably engageable in a hook holder provided on the outer face of the magnetic base and a supporting section adapted to support the object.

12 Claims, 5 Drawing Sheets

MAGNETIC BASE HOLDER

This is a continuation of provisional application Ser. No. 60/089,876 filed on Jun. 19, 1998. The present invention relates to the field of magnetic bases for holding an object to a magnetizable surface. More particularly, it relates to the field of window shade accessories.

FIELD OF THE INVENTION

Background of the Invention

Steel doors or windows are largely used as they provide many advantages over wood doors or windows. However, when it comes to the installation of door or window accessories such as hangers for coats or window shade, such as curtains, café curtains, horizontal or vertical blinds, also called Venitian blinds, or roller blinds, those steel doors and windows do have certain drawbacks as compared to wood doors or windows. These accessories are relatively easy to attach to a wooden surface and if they are temporarily attached thereto, it is easy afterwards to repair the holes left in the wood. The attachment of these accessories to a steel wall is more complicated as it generally necessitates to drill holes in the steel surface and if the accessories are removed after a while the holes left in the surface, on one hand, deteriorate the appearance of the surface and, on the other hand, may cause problems of water leakage or of rust-out. Different types of magnetic base holders have been proposed in prior art to resolve this drawback.

Already known in prior art there is U.S. Pat. No. 5,411,231 in the name of Buck which describes a device for removably holding a non-magnetic object to a selectable location on a magnetic component without penetrating the surface of the magnetic component. This device comprises a magnet attached to a metal cup member and is of particular interest in that the metal cup member has a peripheral lip which serves as a means to provide an air gap between the steel door and the magnet to vary the intensity of the magnetic field therebetween. However, the manufacturing of this device, which is believed to be of complex construction, can be very expensive as compared to its retail price. Furthermore, this device is not very versatile, as it does not allow a user to rapidly replace its window shade of a given type to one of another type, for example replacing a roller blind to a horizontal blind. To do so the hook disclosed by Buck has to be unscrewed and then replaced by another hook or bracket adapted to the other type of window shade.

Also known in prior art, there is Canadian patent No. 2,077,023 in the name of Miller, which describes a magnetic device for magnetically attaching a curtain rod to a ferrous metal surface. This device had shown to be not satisfactory as it cannot hold certain heavy window shades such as vertical blinds. Furthermore as for the device described by Buck, this is not a versatile hanging device.

Other examples of magnetic base holders or window shade holders are disclosed in U.S. Pat. Nos. 5,746,329; 4,727,462; 2,977,082; 2,609,042; 3,023,991; 5,078,281; 3,239,179; 2,813,710; 3,118,207; 3,275,818; 4,060,905; and 4,373,569.

There is still presently a need for a versatile cost effective device for holding different types of objects, heavy or not, to a magnetizable surface.

SUMMARY OF THE INVENTION

An object of the present invention is to propose a device that satisfies the above-mentioned need.

In accordance with the present invention, that object is achieved with a device for holding an objet to a magnetizable surface, comprising:

a magnetic base comprising:

a magnet having an external face devised to face the magnetizable surface, an internal face opposite the external face and a sidewall; and a housing in which the magnet is recessed, the housing being sized to accommodate the magnet in a loose manner so that an air gap is formed between the housing and the magnet, the housing comprising a side wall extending beyond the side wall of the magnet so that, in use, another air gap is formed between the external face of the magnet and the magnetizable surface, the housing also including a base wall having an inner face opposite an outer face, the internal face of the magnet being secured to the inner face of the base wall.

The device further has a hook comprising an anchoring section slidably engageable in a hook holder provided on the outer face of the magnetic base, the hook also comprising a supporting section adapted to support the object.

Preferably, the magnetic base further comprises a sheet of flexible foam material covering the external face of the magnet to increase the magnetic force of the magnetic base. Also preferably, the hook holder consists of a runner cut in a sheet of metal forming the housing.

The device according to the present invention provides a system that allows any type of accessories, namely window shade accessories, to be installed on a magnetizable surface without disturbing the integrity of the same. A holder according to the present invention does not require performing any holes on the surface. It provides a simple and easy way not only to install a specific type of window shade but also to replace a former window shade of a given type by a new window shade of a completely different type without requiring any tools. Furthermore, because of its specific construction, a device according to the invention renders possible the attachment of a heavy accessory such as a vertical blind to a magnetizable surface.

BRIEF DESCRIPTION OF THE DRAWINGS

A non-restrictive description of preferred embodiments of the present invention will be given with reference to the appended drawings.

In the following description and drawings, the same numeral references will refer to the same structural elements.

DESCRIPTION OF PREFERRED EMBODIMENTS

The description of Application Ser. No. 09/184,244 entitled "Window shade holding system" filed the same day as the present application is incorporated by reference.

The following description of preferred embodiments of the present invention are all directed to window shade holders. However it has to be understood that the invention is not limited to those precise embodiments and may have other uses such as hangers for coat or suspension bars for clothings or towels.

Figure 1:
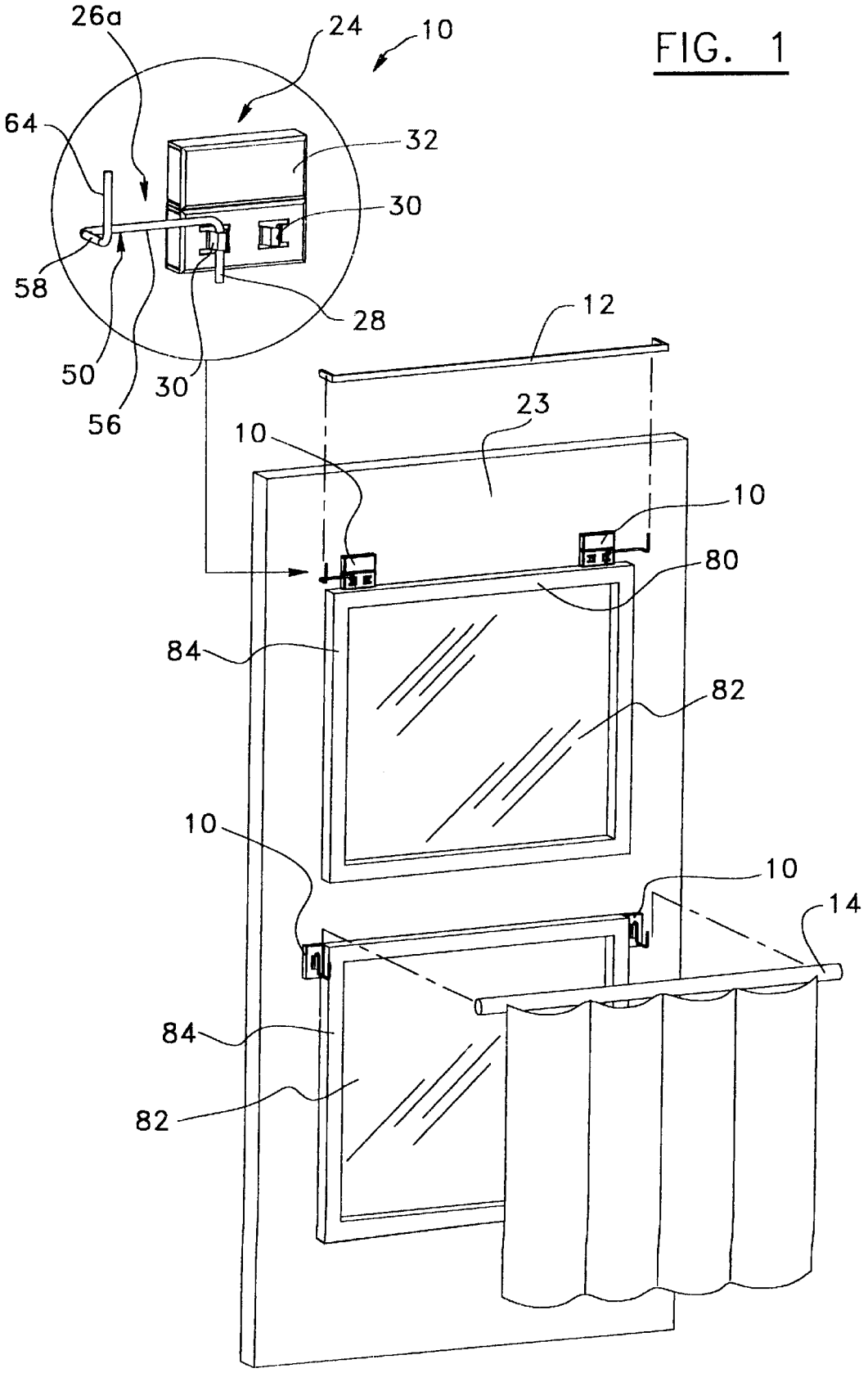
FIG. 1 is a perspective view of a steel door to which two pairs of window shade holders according to preferred embodiments of the present invention are attached.
Figure 2:
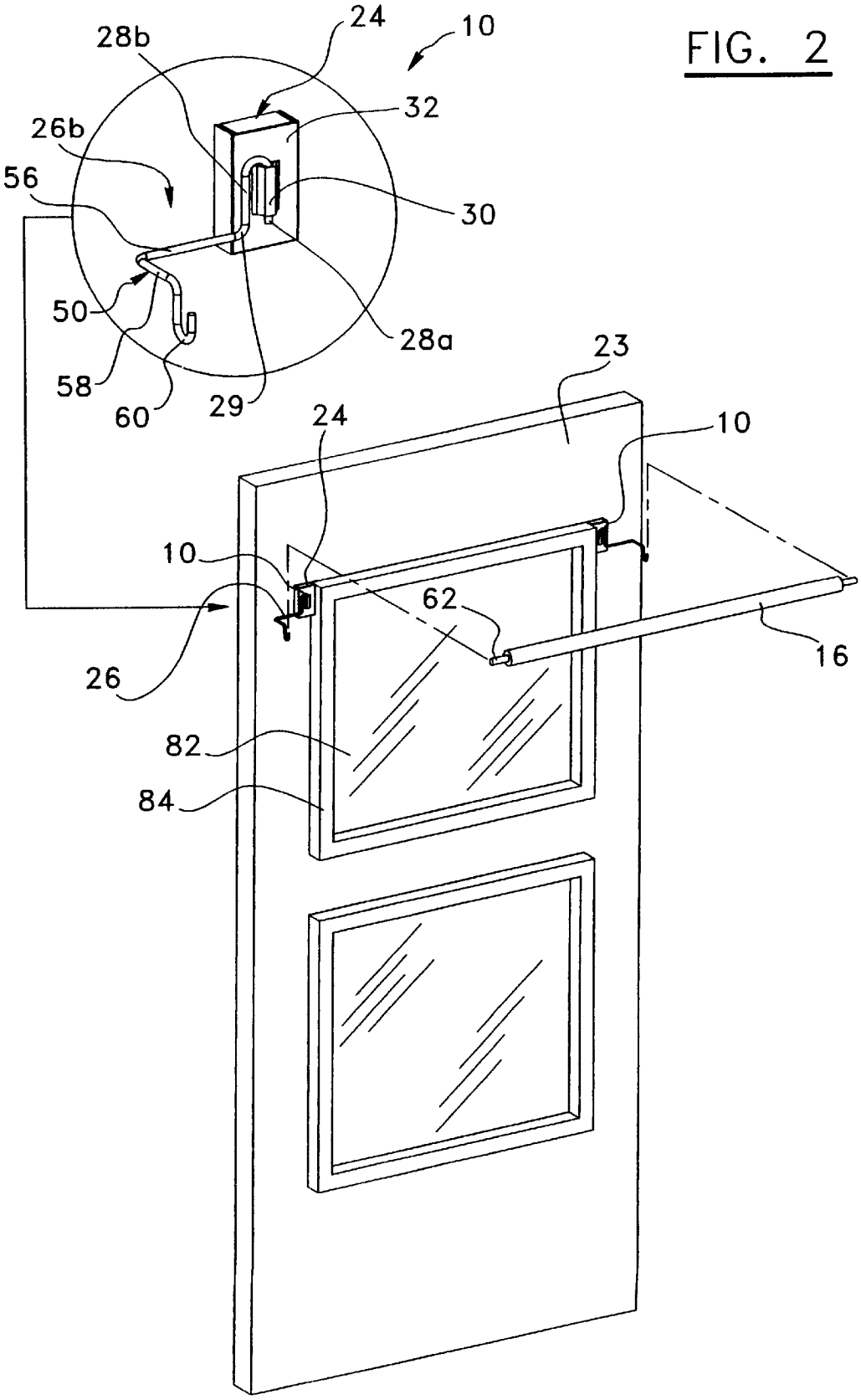
FIG. 2 represents the same steel door as shown in FIG. 1 with another preferred embodiment of the present invention attached thereto.
Figure 3:
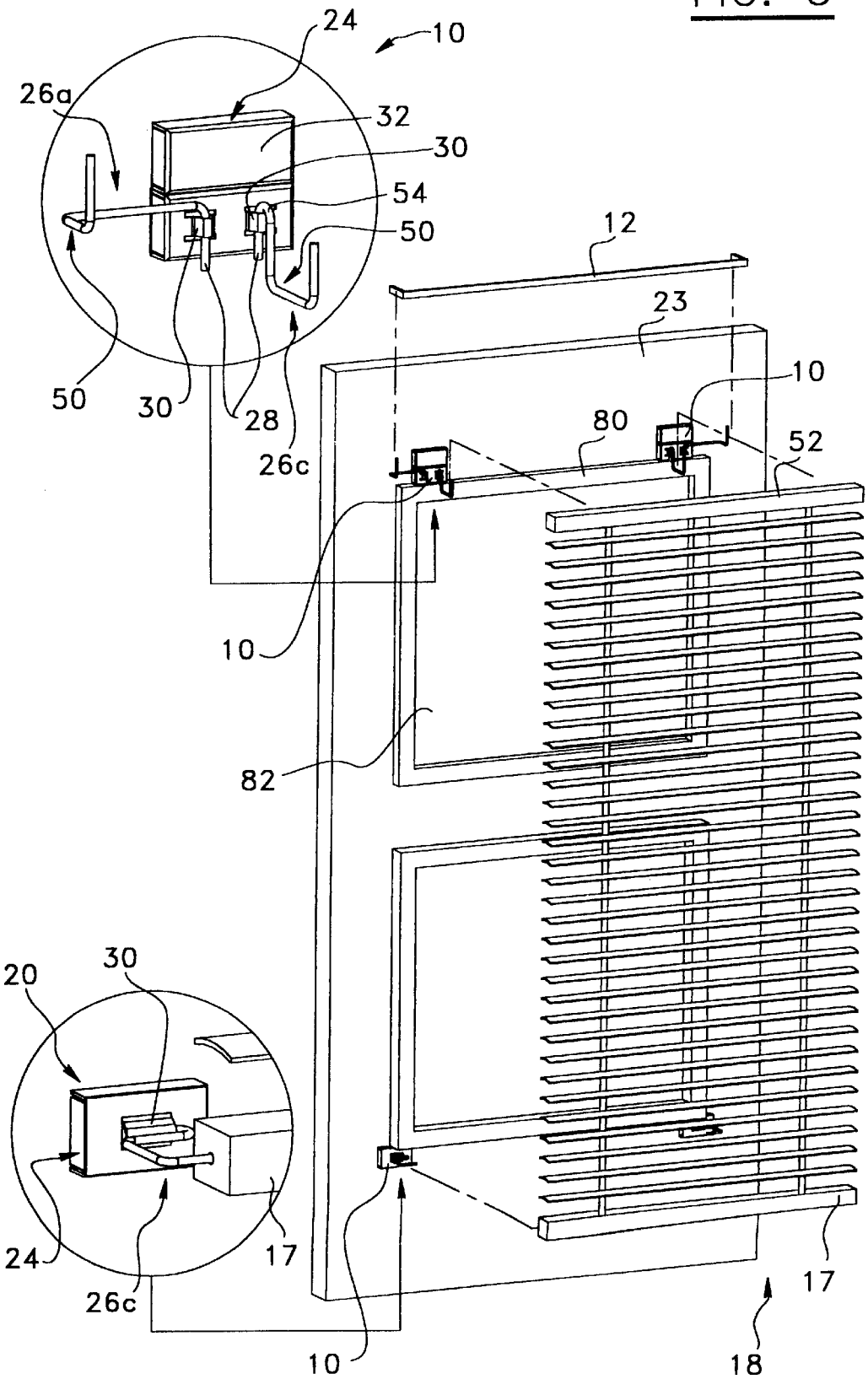
FIG. 3 represents the same steel door as shown in FIGS. 1 and 2 with still further preferred embodiments of the invention attached thereto.
Figure 6:
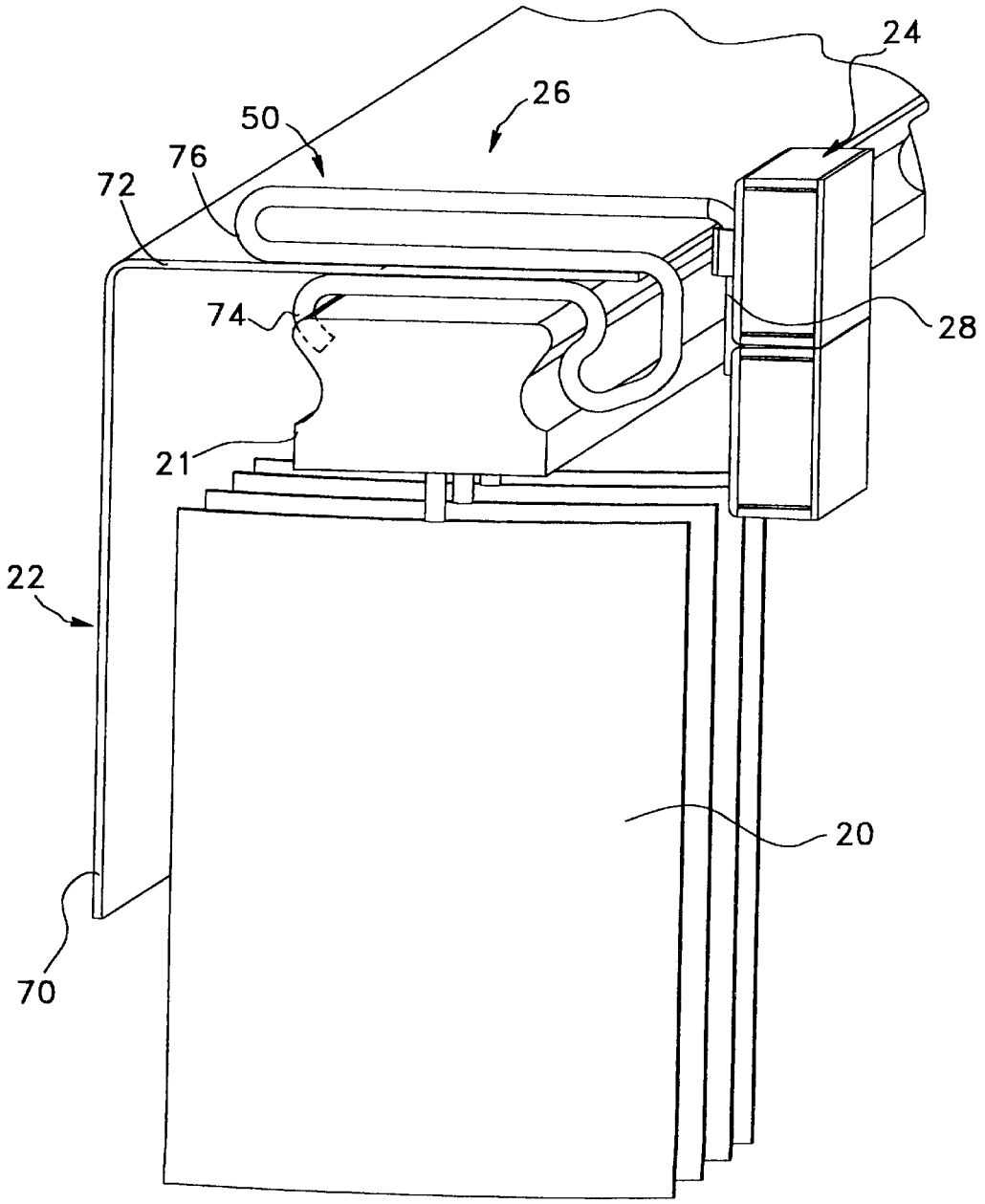
FIG. 6 is a perspective view of a window shade holder according to another preferred embodiment of the present invention adapted to hold both a vertical or horizontal blind and a cornice decorating the head of the blind.

Referring to FIGS. 1 to 3, a window shade holder (10) embodying features of the present invention may be suitable for holding different types of window shades to a magnetizable wall surface (23) such as a steel door or a steel window assembly. For example, it can be used for holding a U-shaped curtain rod (12) or a standard pole (14) for curtain as shown in FIG. 1; a roller blind (16), as shown in FIG. 2; a horizontal blind (18), as shown in FIG. 3 or both a vertical blind (20) and a cornice (22) for heading the blind, as shown in FIG. 6. Advantageously, it may also be used for retaining in place the base (17) of a horizontal blind (18), as shown in FIG. 3. As can be appreciated, the window shade holder (10) comprises a magnetic base (24) and a hook (26) removably connectable to the magnetic base (24). More specifically, the hook (26) comprises an anchoring section consisting of a downwardly extending leg (28) slidably engageable in a hook holder (30) formed on the outer face (32) of the magnetic base (24). The hook (26) further comprises a supporting section (50) adapted to support a window shade rail, pole or rod (either of 12, 14, 16, 18, 20, 22).

Figure 5:
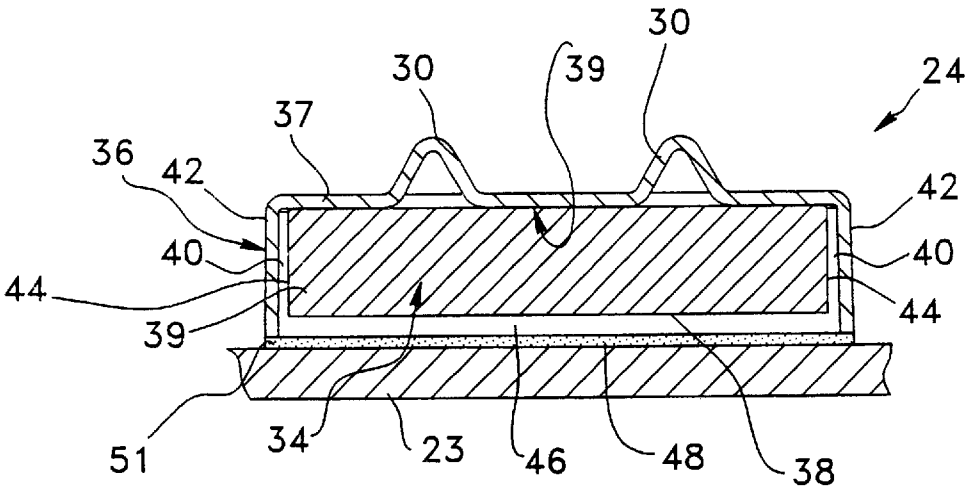
FIG. 5 is a cross-sectional view taken along line IV—IV of FIG. 4 showing the magnet enclosed in the housing.
Figure 4:
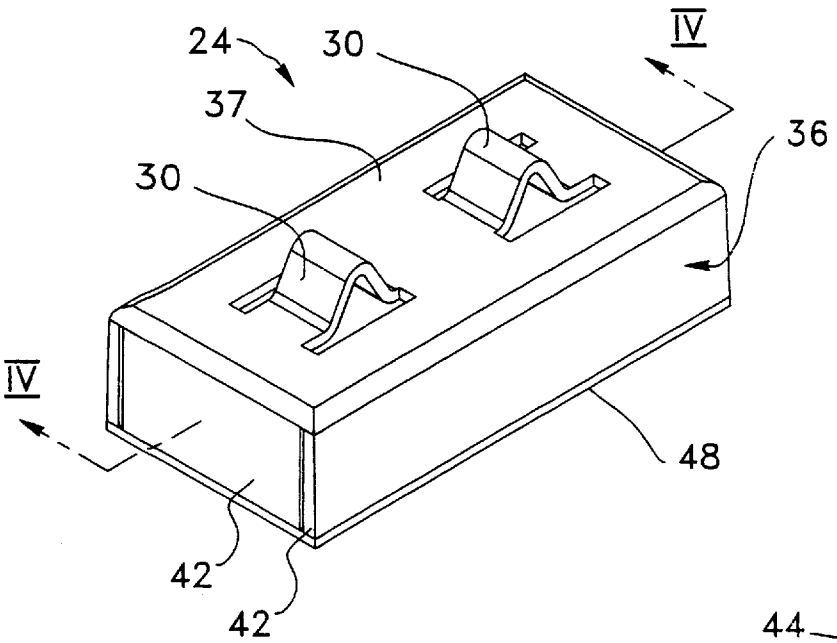
FIG. 4 is a top perspective view of a magnetic base of the present invention according to a preferred embodiment thereof.

Referring also to FIGS. 4 and 5, the magnetic base (24) comprises a rectangular, circular, triangular, or any other shape, magnet (34) recessed in a housing (36) having a base wall (37) and side walls (42). The magnet (34) has an external face (38) devised to face the wall surface (23) to which the holder (10) will be attached. The internal face (39) of the magnet (34) is secured, preferably glued, to the inner face of the base wall (37) of the housing (36). As can be appreciated, the housing (36) defines a recess sized to accommodate the magnet (34) in a loose manner so that an air gap (40) is formed between the sidewall (42) of the housing (36) and the sidewall (34) of the magnet (34). The sidewalls of the housing (42) extend beyond the sidewalls of the magnet (44) so that, in use, another air gap (46) is formed between the external face (38) of the magnet (34) and the wall surface (23). In other words, the volume of the magnet (34) is smaller than the volume of the recess defined by the housing (34). The air gaps (40, 46) so formed greatly increase the magnetic force of the magnet and thereby allow heavy accessories to be hung with the holder.

Preferably, in order to increase further the magnetic force of the holder (10), the magnetic base (24) comprises a sheet of flexible foam (48) covering the external face (38) of the magnet (34). The foam used preferably comprises semi-open cells. The semi-open cellular foam (48) is installed on the housing such that the cells of the foam are all open towards the exterior of the housing thereby increasing the adherence of the holder (10) to the wall under the effect of the suction. The outline (51) of that sheet of material (48) may be simply glued to the sidewalls' extremity (42) of the housing (36).

Referring more specifically to FIGS. 4 and 5, the hook holder (30) of the housing (36) preferably consist of a runner cut and formed in the sheet of metal forming the housing (36). Advantageously, as shown, the magnetic base (24) may comprise two or more of said hook holders (30) thereby allowing a user to install more than one window shade. For example, with only a pair of said window shade holders, it may be possible to install a horizontal blind and a curtain, as shown in FIG. 3 or a curtain and a roller blind.

Referring to FIG. 1 more particularly, and 3 also, a hook (26*a*) according to a first preferred embodiment of the present invention (26) may be adapted to hold an end portion of a U-shaped curtain rod (12). In that case, the supporting section (50) has a spacing segment (56) bent integrally and perpendicularly from an upper end of the anchoring section (28), and a free segment (58) perpendicular to the spacing segment (56) and to the anchoring section (28) which consists of a downwardly extending leg. The free segment (58) is integrally bent from an end of the spacing segment (56) and has an extremity bent upwardly into a rectilinear dowel (64) to engage and support the end portion (13) of the U-shaped curtain rod (12). Preferably, the rectilinear dowel (64) of the supporting section (50) is slightly angled toward the free segment (58). In that case, the magnetic base (24) preferably comprises two runners (30) formed transversely on the housing (24) so that the magnetic base (24) may be attached along the top frame (80) of the window (82).

Referring to FIG. 2, a hook (26*b*) according to a second preferred embodiment may be adapted to hold a roller blind (16). In that case, the anchoring section (28) of the hook (26*b*) is bent in the shape of a hairpin defining a first leg (28*a*) and a second leg (28*b*), the first leg (28*a*) having a free end slidably insertable into the runner (30) of the housing (36). The supporting section (50) has a spacing segment (56) bent integrally and perpendicularly from a lower end (24) of the second leg (28*b*) and a free segment (58) perpendicular to the spacing segment (56) and to the second leg (28*b*). The free segment (58) is integrally bent from an end of the spacing segment (56) and has an extremity (60) adapted to receive and support an end pin (62) of a roller blind (16). Preferably, that extremity (60) has an eyelet shape or a U shape, as shown in FIG. 2. It has to be noted that in that case the runner (30) is formed longitudinally on the housing (24) so that the magnetic base may be easily attached along the side (84) of the window (82).

Referring to FIG. 3, the supporting section (50) of a hook (26*c*) according to a third preferred embodiment may have a U shape adapted to receive and support a length of a window shade rail (52) of a horizontal blind (18) or a curtain pole (12), for example. More particularly, in that case the U of supporting section (50) has one end with a 180 degree elbow (54) which integrally bend into the anchoring section (28). Advantageously, that hook (26*c*) may also be used for keeping in place the base (21) of a horizontal blind (18).

Referring to FIG. 6, the supporting section (50) of a hook (26*d*) according to a fourth preferred embodiment may be shaped so as to hold a vertical blind headrail (21) and a L-shaped cornice (22) of the type including a front panel (70) to face the headrail (21) and a horizontal lath (72). In that case, the supporting section (50) of the hook (26*d*) comprises a lower part (74) shaped as a grip to grip a top end of the headrail (21) and a upper part (76) above the lower part (74) shaped as flat pliers to receive and hold the horizontal lath (72) of the cornice (22).

As can be appreciated, a device according to the present invention proves to be very advantageous over prior art magnetic base holding systems. First, thanks to the improved structural characteristics of its magnetic base which provides air gaps between the magnet, the housing and the surface to which the base is attached, the magnetic force of the base is greatly increased thereby rendering possible the attachment of heavy objects such as a vertical blind to a magnetizable surface with a magnetic base.

Second, and thanks to the fact that the hook is removably connectable to the housing without requiring any tools, it renders the replacement of a window shade of a given type by one of another type very easy and fast.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A device for holding an object to a magnetizable surface, comprising:

a magnetic base including a magnet having an external face devised to face the magnetizable surface, an internal face opposite the external face, and a side wall; and a housing in which the magnet is recessed, said housing being sized to accommodate the magnet in a loose manner so that an air gap is formed between the housing and the magnet, said housing having a side wall extending beyond the side wall of the magnet so that, in use, another air gap is formed between the external face of the magnet and the magnetizable surface; and a base wall having an inner face opposite an outer face, said internal face of the magnet being secured to the inner face of the base wall;

a sheet of flexible semi-open cellular foam covering the external face of the magnet to increase the magnetic force of magnetic base; and a removable hook including an anchoring section slidably engageable in a hook holder provided on the outer face of the magnetic base and a supporting section adapted to support said object.

2. A device as claimed in claim 1, wherein the hook holder consists of a runner cut and formed in a sheet of metal forming the housing.

3. A device as claimed in claim 2, wherein the magnetic base comprises at least two of said hook holders.

4. A device as claimed in claim 3, wherein the anchoring section of the hook consists of a downwardly extending leg slidable in the runner.

5. A device as claimed in claim 4, wherein the supporting section of the hook has a U shape adapted to receive and support a section of a window shade rail, the U of the supporting section having one end with a 180 degree elbow which integrally bends into the downwardly extending leg.

6. A device as claimed in claim 3, wherein the anchoring section of the hook is bent in the shape of a hairpin defining a first leg and a second leg, the first leg having a free end slidably insertable into the runner, and wherein the supporting section has:

a spacing segment bent integrally and perpendicularly from a lower end of said second leg, and a free segment perpendicular to the spacing segment and to the second leg, the free segment being integrally bent from an end of said spacing segment and having an extremity adapted to receive and support an end pin of a roller blind.

7. A device as claimed in claim 6, wherein the extremity of the free segment of the supporting section has an eyelet shape.

8. A device as claimed in claim 6, wherein the extremity of the free segment of the supporting section has a U shape.

9. A device as claimed in claim 4, wherein the supporting section has:

a spacing segment bent integrally and perpendicular from an upper end of said leg of the anchoring section, and a free segment perpendicular to the spacing segment and to the leg, said free segment being integrally bent from an end of said spacing segment and having an extremity bent upwardly into a rectilinear dowel to engage and support an end portion of a U-shaped curtain rod.

10. A device as claimed in claim 9, wherein the rectilinear dowel of the supporting section is slightly angled toward the free segment.

11. A device as claimed in claim 4, wherein the supporting section of the hook is shaped so as to hold a vertical blind headrail and a L-shaped cornice of the type including a front panel to decorate the headrail and a horizontal lath, the supporting section of the hook comprising a lower part shaped as a grip to grip a top end of the headrail and an upper part above the lower part shaped as flat pliers to receive and hold the horizontal lath of the cornice.

12. A window shade holder for holding a window shade rail to a magnetizable surface, comprising:

a magnetic base including a magnet having an external face devised to face the magnetizable surface, an internal face opposite the external face, and a side wall; and a housing in which the magnet is recessed, said housing being sized to accommodate the magnet in a loose manner so that an air gap is formed between the housing and the magnet, said housing having a side wall extending beyond the side wall of the magnet such that in use, another air gap is formed between the external face of the magnet and the magnetizable surface, and a base wall having an inner face opposite an outer face, said internal face of the magnet being secured to the inner face of the base wall;

a sheet of flexible semi-open cellular foam covering the external face of the magnet to increase the magnetic force of magnetic base; and a removable hook including an anchoring section slidably engageable in a hook holder provided on the outer face of the magnetic base and a supporting section adapted to support a section of the window shade rail.

* * * * *